US009472389B2

(12) United States Patent
Krummen et al.

(10) Patent No.: US 9,472,389 B2
(45) Date of Patent: Oct. 18, 2016

(54) ION SOURCE ASSEMBLY FOR STATIC MASS SPECTROMETER

(71) Applicant: Thermo Fisher Scientific (Bremen) GmbH, Bremen (DE)

(72) Inventors: Michael Krummen, Bremen (DE); Michael Deerberg, Bremen (DE); Johannes Schwieters, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/440,767

(22) PCT Filed: Nov. 15, 2013

(86) PCT No.: PCT/EP2013/073975
§ 371 (c)(1),
(2) Date: May 5, 2015

(87) PCT Pub. No.: WO2014/076248
PCT Pub. Date: May 22, 2014

(65) Prior Publication Data

US 2015/0287582 A1 Oct. 8, 2015

(30) Foreign Application Priority Data

Nov. 16, 2012 (GB) ..... 1220648.8

(51) Int. Cl.
*H01J 49/28* (2006.01)
*H01J 49/10* (2006.01)
*H01J 49/16* (2006.01)

(52) U.S. Cl.
CPC ..... *H01J 49/10* (2013.01); *H01J 49/28* (2013.01); *H01J 49/168* (2013.01)

(58) Field of Classification Search
CPC ..... H01J 49/10; H01J 49/168; H01J 49/28; H01J 49/30; H01J 49/147
See application file for complete search history.

(56) References Cited

U.S. PATENT DOCUMENTS 2,444,968 A * 7/1948 Washburn ..... H01J 49/147 250/427
2,709,222 A * 5/1955 Lawrence ..... B01D 59/48 250/284
2,712,072 A * 6/1955 Sayers ..... H01J 49/30 250/425
2,712,079 A * 6/1955 Hunter ..... H01J 49/30 250/284
2,727,150 A * 12/1955 Lawrence ..... H01J 49/126 250/281
2,737,589 A * 3/1956 Brobeck ..... H01J 49/126 250/425
2,874,295 A * 2/1959 Oppenheimer ..... H01J 49/126 250/396 R (Continued)

FOREIGN PATENT DOCUMENTS

CN 202454525 U 9/2012
GB 961334 A 6/1964
GB 1357263 A 6/1974

*Primary Examiner* — Wyatt Stoffa
(74) *Attorney, Agent, or Firm* — David A. Schell

(57) ABSTRACT

An ion source assembly for a static mass spectrometer, comprises: a mounting element for locating the assembly within the static mass spectrometer; an ion source for generating ions to be analyzed in the static mass spectrometer, the ion source being spaced from the mounting element and arranged to be held in use at a first relatively high potential $V_1$ with respect to the mounting element; and a spacer mounted between the mounting element and the ion source, the spacer arranged to be held in use at a second potential $V_2$ with respect to the mounting element, which is less than the first potential $V_1$.

20 Claims, 5 Drawing Sheets

(56) References Cited

U.S. PATENT DOCUMENTS 3,217,160 A * 11/1965 Craig ..... H01J 49/147
250/423 R
3,234,379 A * 2/1966 Wanless ..... H01J 49/30
250/427
3,356,843 A * 12/1967 McElligott ..... H01J 49/14
250/427
3,723,729 A * 3/1973 Kruger ..... H01J 49/14
250/427
2002/0125426 A1* 9/2002 Hirabayashi ..... H01J 49/045
250/288
2005/0001161 A1* 1/2005 Hiraoka ..... H01J 49/145
250/282
2012/0205534 A1* 8/2012 Hunter ..... H01J 49/0013
250/282

* cited by examiner

ION SOURCE ASSEMBLY FOR STATIC MASS SPECTROMETER

FIELD OF THE INVENTION

This invention relates to an ion source assembly for a static mass spectrometer, and to a static mass spectrometer having such an ion source assembly.

BACKGROUND OF THE INVENTION

Static mass spectrometers are used when the highest possible degree of sensitivity is required. Analysis is typically conducted for detecting the presence of minute quantities of noble gases (He, Ne, Ar, Kr, Xe), but they may also be capable of analyzing gases such as $CO_2$ or $N_2$.

The operation of static mass spectrometers exhibits several special features. A characteristic feature of static mass spectrometers is that they stay evacuated but are not pumped during analysis.

The main components of a static mass spectrometer comprise an ion source, an analyzer, an ion detector and a pump for generating a high vacuum in the mass spectrometer. Operations commence with the generation of a high vacuum in the mass spectrometer. Then the mass spectrometer is disconnected from the pump (normally by means of a valve) and minute quantities of the gas to be analyzed are admitted to the mass spectrometer.

Referring to FIG. 1, there is shown a typical schematic configuration of an existing static mass spectrometer 200, comprising: a sample preparation region 205; a transfer region 230; an ion source region 240; and a mass analyzer 250. The sample preparation region 205 comprises a furnace 210 and an optional preparation bench 220. Between each of the furnace 210, the sample preparation bench 220, the transfer region 230 and the ion source region 240, valves 215 are provided.

The admission to the static mass spectrometer 200 is indirect via an intermediate chamber. A normal application is the determination of the isotope ratios of various isotopes of a noble gas that is trapped in a sample, such as a piece of rock or similar.

In current instruments, the sample, typically a piece of rock, is put into a chamber (such as furnace 210) and then heated, possibly with a laser. This treatment releases trapped gases, which comprise the desired analytes. The released gases are transferred to the sample preparation bench 220, where they may be manipulated in various ways. For example, they may be partially or wholly transferred to storage volumes ("pipettes") and then they may be partially released, giving a smaller amount of sample at a lower pressure.

The gas is then transferred to the transfer region 230, which may act as a cleaning unit. In older devices, the gas was collected on a cold finger. More modern device comprise a general type of "trap" installed, typically comprising chemical getters to remove unwanted substances (this usually means everything but noble gases). The getters are cryo-cooled and may be thawed to "distill" the gases, releasing them one after another. From this moment onwards, the pumps are closed off by valves before the sample is released into the chamber (240, 250).

From here, the gas is thawed and equilibrated with the ion source region 240 where the gas is ionized (Electron Ionization) and the ions are subsequently analyzed in the mass analyzer 250. The noble gas need not always be frozen (and then thawed), for example the lighter gases such as helium and neon which are difficult to freeze. Then, the noble gas would pass straight to the ion source region 240 with just the impurities being frozen out in the transfer region. In such embodiments, the gas to be analysed is equilibrated with the ion source after the transfer region 230.

In the ion source 240, the gas to be analyzed is typically ionized by means of electron bombardment. Due to the statistical distribution in the mass spectrometer of the gas to be analyzed, there are only a small number of molecules in the region of the ion source. This therefore results in only a small ion stream.

Typical pressures in the ion source region 240 and mass spectrometer 250 are $10^{-9}$ to $10^{-10}$ mbar before the sample is admitted and subsequently, $10^{-6}$ to $10^{-7}$ to $10^{-9}$, depending on the sample amount (which cannot always be predicted). The gas to be analyzed spreads throughout the ion source region 240 and the mass analyser 250, with a few molecules also entering the ion source. In the mass analyser 250, the ions from the ion source travel along a flight tube 255 before being detected in detector region 260.

The strong vacuum and the removal of "uninteresting" gases from the sample are very desirable to improve the signal to noise ratio (that is the ion count from the sample against the ion count from other gases remaining from a previous measurement or other "interferences", such as isobaric ions like hydrocarbons).

In static mass spectrometry, the interior free volume for the gas becomes a major performance parameter. The sensitivity is directly proportional to the interior volume, such that the larger the volume of the instrument, the lower the sensitivity. Similarly large surfaces are feared as sources of contamination as well as potential places for sample to settle on, leading to reduction of sensitivity and possibly memory effects (of the type noted above that might affect the signal to noise ratio). However, reducing the volume normally results in a reduction in the distance between high voltage parts of the ion source and the grounded source housing. This significantly increases the risk of undesirable current discharge from the ion source. A high potential is required to effect ionization, whereas the housing defining most of the ionization volume dimensions is usually grounded leading to the risk of sparking.

SUMMARY OF THE INVENTION

Against this background, the present invention provides an ion source assembly for a static mass spectrometer, comprising: a mounting element for locating the assembly within the static mass spectrometer; an ion source for generating ions to be analyzed in the static mass spectrometer, the ion source being spaced from the mounting element and being held, in use, at a first relatively high potential $V_1$ with respect to the mounting element; and a spacer mounted between the mounting element and the ion source, the spacer being held at a second potential $V_2$ with respect to the mounting element, which is less than the ion source potential $V_1$. Normally, the mounting element is held, in use, at a ground potential.

The arrangement of the ion source assembly of the invention permits the total free volume within the ion source assembly to be reduced. This in turn allows more molecules to be available for ionization in the ion source. For a given amount of sample, reducing the total volume increases the number of molecules per unit volume (that is the pressure), and by increasing the pressure in the ionization volume, more ions are produced. The sensitivity is therefore increased.

By holding the spacer at a voltage intermediate ground and the ion source, the risk of arcing from the ion source assembly is reduced. Then, the ion source and mounting element (which may comprise a housing) can be made more compact such that the free volume is smaller.

The ion source assembly of the invention thereby reduces the quantity of gas that can successfully be analyzed in a static mass spectrometer, when compared with prior art arrangements. In this way, extremely minute quantities of gas can be analyzed, such as typically present in small pieces of rock.

Contrastingly, the addition of a spacer may increase the surface area within the free volume. This is conventionally understood to be undesirable. Introduction of sample into the free volume tends to cause a surface layer to be formed first. Only once a mono-layer is established do the remaining molecules tend to remain in free space, allowing their ionization. On this basis, larger surface areas within the free volume have normally been avoided. Whilst the addition of the spacer increases the surface area available for mono-layer formation, it has advantageously been recognised that for a given dimension of spacer, the surface area increases by a power of two but the volume decreases by a power of three. Hence, the problems caused by an increase in surface area are not detrimental. In comparison, the advantages gained by the reduction in free volume are significant.

A further benefit of the invention is that the first potential $V_1$ may be set significantly higher in comparison with the prior art. This is advantageously achieved at the same time as the improved protection against arcing and smaller free volume.

Preferred features of the invention are set out in the dependent claims.

In the preferred embodiment, the ion source is supported upon the spacer whilst being electrically isolated therefrom. Then, the assembly may further comprise one or more electrical feed throughs which pass through but are insulated from the spacer and the mounting element. Advantageously, the mounting element comprises a flange.

Preferably, the spacer is formed of a conductive material. More preferably, the spacer is metallic. Using a conductive material, particularly a metal as a spacer can avoid undesirable properties associated with insulators, especially ceramics. The key properties may include: a larger surface area; higher adsorption or absorption of humidity, giving problems after venting; a tendency to glowing with high voltage across it; outgassing (at least ceramics); and charging (the potential on isolators is generally undefined because incident charges have nowhere to go).

Optionally, the assembly further comprises a spacer support structure that positions the spacer relative to the mounting element. In the preferred embodiment, the mounting element comprises a flange and the spacer support structure is affixed to the flange. In specific embodiments, the mounting element comprises a housing and the spacer may be a flange (preferably affixed to the housing). The sealing surface of the flange may then act as an insulator and the vacuum side may be shaped to act as the spacer. For example, the sealing surface may be covered with glazed ceramics (which is possible because gold-seals that are commonly used are soft) or some other material to insulate it from the other parts of the mounting element, such as the housing. Then, it may be insulated against the remainder of the vacuum system and could be held at any desired potential.

The assembly may further comprise an ion source support structure that positions the ion source relative to the spacer. Preferably, the ion source support structure is affixed to the spacer. Preferably, the ion source support structure comprises electrical isolation between the ion source and the spacer.

The potentials applied to the spacer and ion source can be set to effect ionization and/or ion acceleration appropriately. Higher acceleration voltages allow higher resolution and better peak-shapes, thus making it easier to distinguish the signal of interest from interferences on the same nominal mass. In some embodiments, the first potential $V_1$ is between 8 kV and 12 kV, but it may be between 9 kV and 11 kV and more preferably is around 10 kV. The second potential $V_2$ may be between 4 kV and 6 kV, but more preferably it is between 4.5 kV and 5.5 kV and most preferably around 5 kV. Advantageously, the second potential $V_2$ is approximately half the first potential $V_1$ (optionally, between 40% to 60% or 45% to 65% of the first potential $V_1$).

Beneficially, the second potential $V_2$ may be set based upon the potential applied to another part of the ion optical component in the ion source assembly or static mass spectrometer. Preferably, the ion source assembly further comprises an ion optical element arranged to be held in use at a potential suitable for acceleration of ions generated by the ion source. Then, the second potential $V_2$ may be the same as the potential at which the ion optical element is arranged to be held. For example, the ion optical element may comprises at least one ion optical lens, such as an ion extraction lens, an ion exit lens and an "intermediate" lens between the ion extraction and ion exit lenses. Then, the second potential $V_2$ may be the same as the potential applied to one or more of the ion optical lenses. Advantageously, the second potential $V_2$ may be provided with the same potential as the intermediate lens. This is a potential that is tuned for maximum performance, such that the absolute voltage on the spacer may vary with it (possibly by up to several hundred volts). In the preferred embodiment, the ion exit lens is set at the same potential as the mounting element, typically ground.

Where the mounting element comprises a flange, the distance between the flange and spacer is preferably less than half the distance between the flange and the ion source. In other words, the distance between the flange and spacer may be less than the distance between the spacer and the ion source. This may result from the relative voltages applied to the spacer and the ion source. Since the voltage applied to the ion source can be around double the voltage applied to the spacer, the spacing between the ion source and the flange may need to be more than double the spacing between the flange and the ion source to avoid arcing.

Optionally, the distance between the mounting element and the spacer is no more than 1 mm per kilovolt (1 mm/kV) of the second potential $V_2$. More preferably, this distance is between 0.4 mm per kilovolt of the second potential $V_2$ and 1 mm per kilovolt of the second potential $V_2$. Advantageously, this distance is no less than 0.6 mm per kilovolt of the second potential $V_2$. Optionally, this distance is no greater than 0.9 mm per kilovolt of the second potential $V_2$. These ranges may be applicable when the second potential $V_2$ is no greater than 5 kV.

Additionally or alternatively, the distance between the mounting element and the ion source is no less than 0.7 mm per kilovolt of the first potential $V_1$. Optionally, this distance is between 0.7 mm per kilovolt of the first potential $V_1$ and 1.5 mm per kilovolt of the first potential $V_1$. Preferably, the distance between the mounting element and the ion source is no less than 1 mm per kilovolt of the first potential $V_1$. These ranges may be applicable when the first potential $V_1$ is no less than 5 kV.

The ion source assembly may further comprise a housing defining an internal volume. Then, the spacer may occupy a specific proportion of the total volume within the housing. Preferably, this proportion is at least 10%. More preferably, this proportion is at least 20%, 25%, 30%, 40%, 50%, 60%, 70% or 75%.

In another aspect, there may be provided a static mass spectrometer comprising: an evacuable housing; an ion source assembly as described herein, mounted upon the housing so that the ion source is located therewithin; and a mass analyser for detecting and analyzing ions generated by the ion source. Optionally, the mass analyser is mounted upon the housing so that the mass analyser is located therewithin.

In a yet further aspect, there is provided a method of operating an ion source assembly for a static mass spectrometer, comprising: applying a first relatively high first potential $V_1$ to an ion source for generating ions to be analyzed in the static mass spectrometer, the ion source being spaced from the mounting element and the first potential $V_1$ being determined with respect to the potential of the mounting element that locates the assembly within the static mass spectrometer; and applying a second potential $V_2$ to a spacer mounted between the mounting element and the ion source, the second potential $V_2$ also being determined with respect to the potential of the mounting element and being less than the first potential $V_1$. It will be appreciated that method steps carrying out any of the functionality described in respect of the ion source assembly and/or static mass spectrometer described herein may optionally be provided as well. Also, the combination of any specific apparatus or method features described herein is provided even if not explicitly described.

BRIEF DESCRIPTION OF THE DRAWINGS

The invention may be put into practice in various ways, one of which will now be described by way of example only and with reference to the accompanying drawings in which.

DETAILED DESCRIPTION OF A PREFERRED EMBODIMENT

Figure 2:
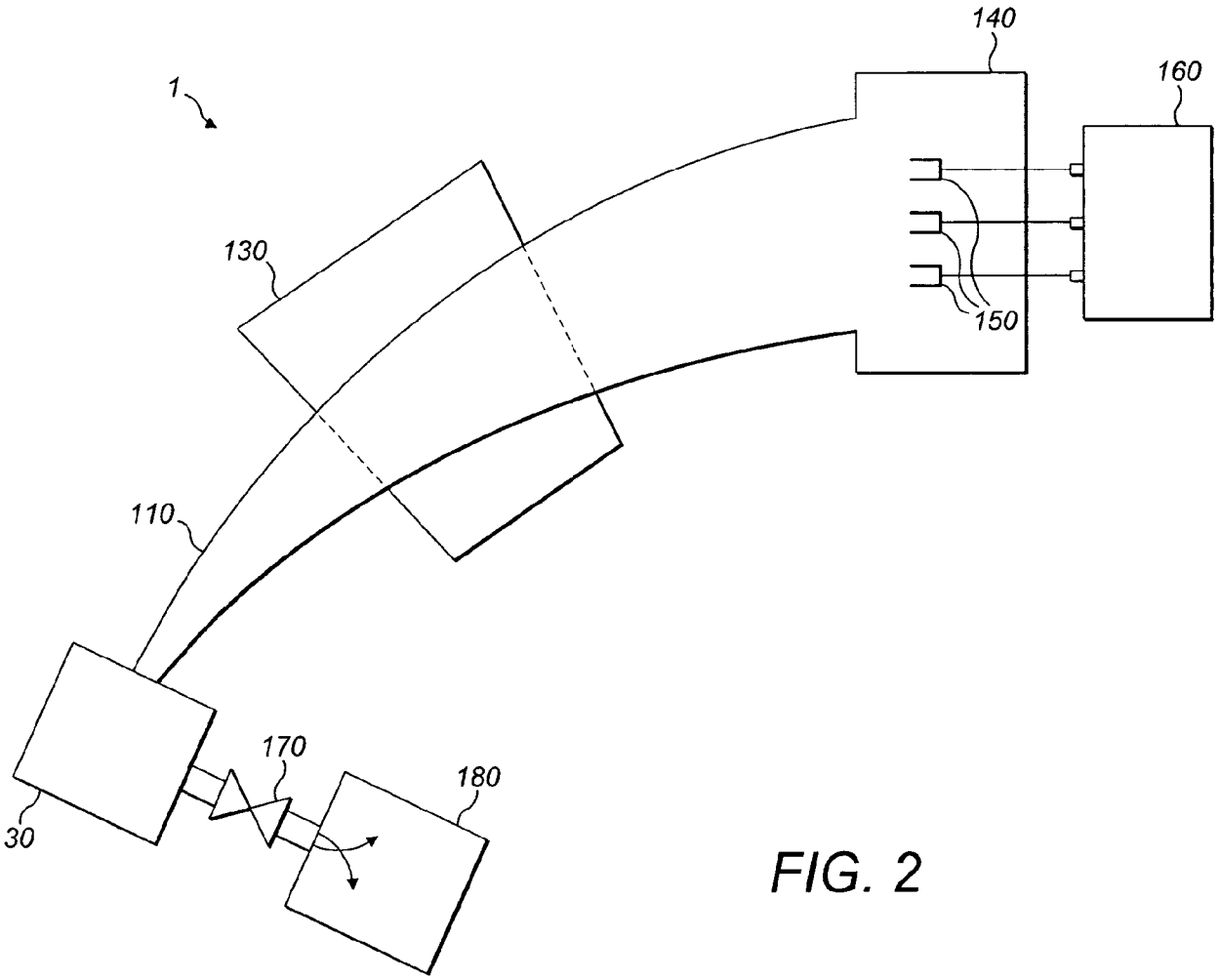
FIG. 2 depicts a schematic arrangement of a static mass spectrometer in accordance with the present invention, comprising an ion source assembly.

Referring first to FIG. 2, there is depicted a schematic arrangement of a static mass spectrometer in accordance with the present invention. The static mass spectrometer 1 comprises: an ion source assembly 30; a flight tube 110; a magnet 130; a detector housing 140; a detector arrangement 150; and electronics 160. A vacuum pump 180 is coupled to the ion source assembly 30 via an automatic valve 170.

Figure 1:
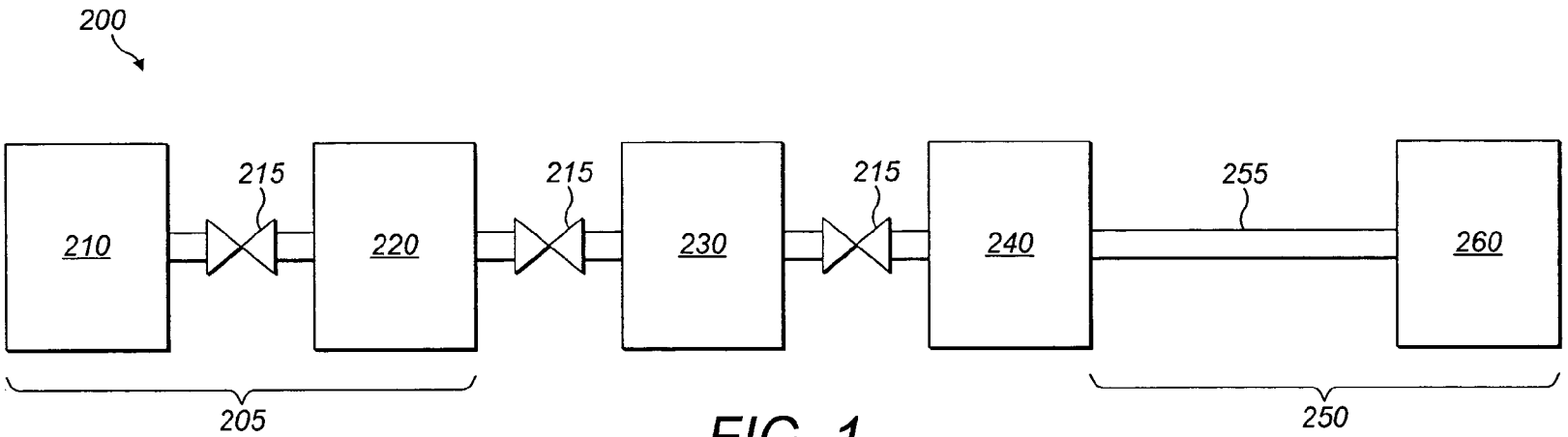
FIG. 1 Prior Art
FIG. 1 illustrates a typical schematic configuration of an existing static mass spectrometer.

The arrangement of the static mass spectrometer does not differ significantly from that shown in FIG. 1, except in respect of the ion source assembly 30. A sample preparation region is not shown in this drawing, but would typically be included. Additionally a further pump (not shown) is connected to the detector housing 140, with a valve (also not shown).

The detector arrangement 150 is shown as a collection device. This could be a Faraday cup, an ion counter or a combination thereof, such as described in WO-2012/007559, which is commonly assigned. Three collectors are shown in FIG. 2, but the preferred embodiment has five collectors and embodiments with more collectors are envisaged as well. The electronics 160 may comprise electronics and/or a computer of a detection system. Moreover, the electronics 160 may comprise a control system, which may further comprise ion source control, valve control, pump control, etc.

Figure 3:
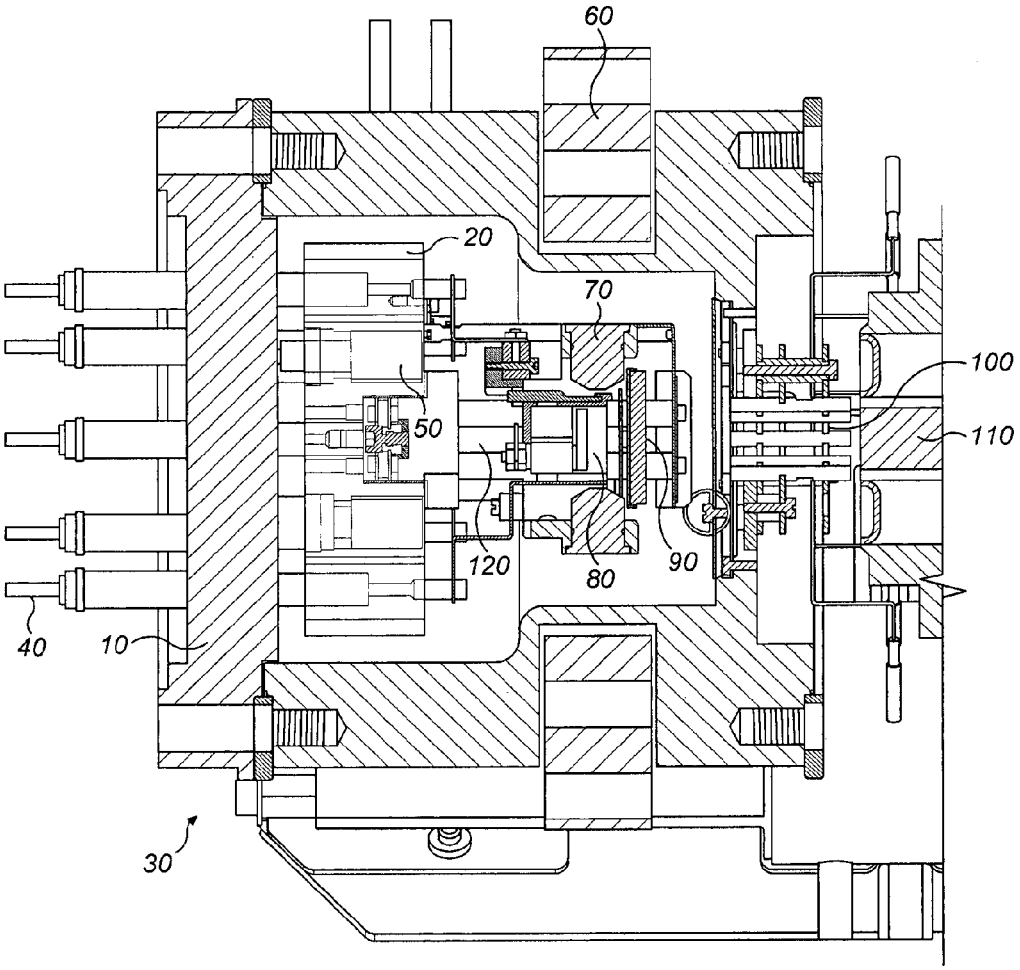
FIG. 3 shows a detailed cross-sectional view of the ion source assembly of FIG. 2.
Figure 4:
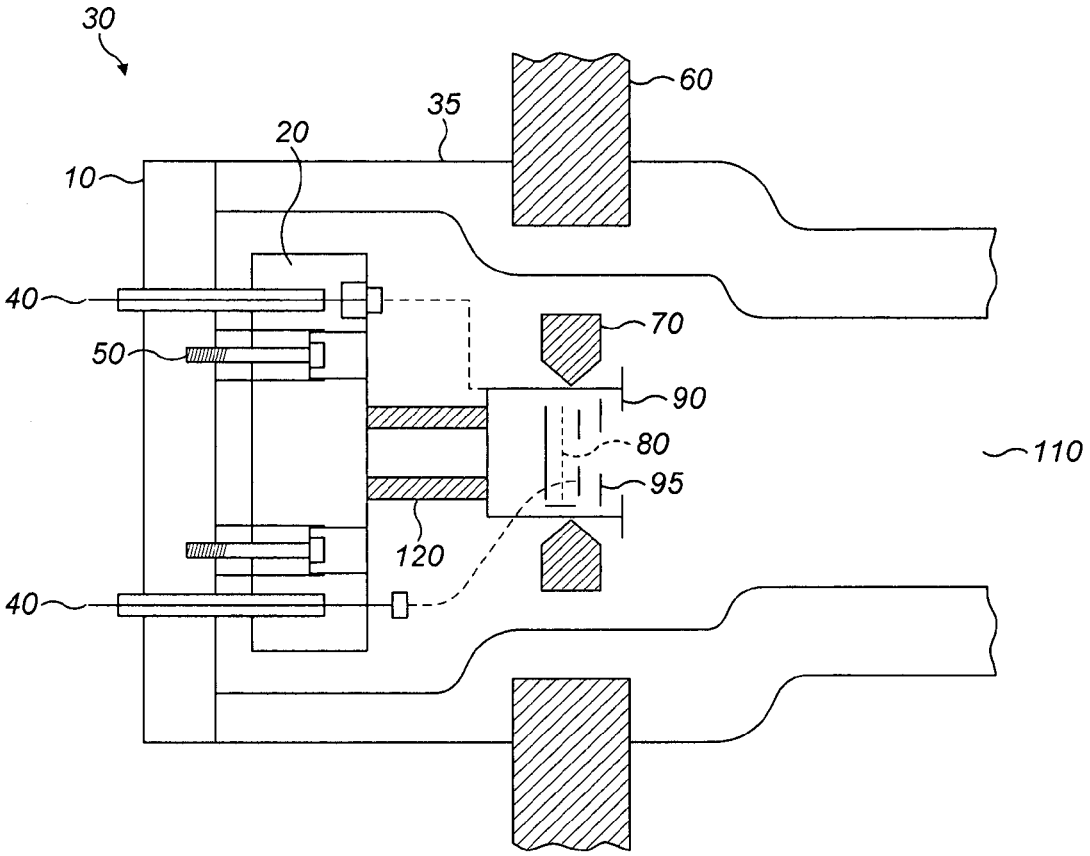
FIG. 4 represents a simplified schematic illustration of the cross-sectional view shown in FIG. 3.

Referring next to FIG. 3 and FIG. 4, there is shown a cross-sectional view of the ion source assembly 30 of FIG. 2. This is shown in detail in FIG. 3, whereas in FIG. 4 a simplified schematic illustration is shown. The ion source assembly 30 comprises: a flange 10; a spacer 20; a source vacuum housing 35; feedthroughs 40; a spacer support structure 50 (isolators and bolts); an ion source magnet 60; a magnetic field focusing element 70 (which may simply comprise a piece of ferrous material, such as iron); an ionization region 80; ion optical elements 90; an intermediate lens 95; a multipole lens 100; and a support structure for the ion source 120. The end of the flight tube 110 is also shown.

The electron ionization source is offset to ground by around 10 kV. This potential is provided using the feedthroughs 40. The length of the connectors may be greater than in a conventional ion source assembly. The spacer 20 (which may also be referred to as a filler) is affixed to the flange 10 using the spacer support structure 50. The spacer support structure 50 also comprises electrical isolation to avoid arcing. The spacer 20 is offset at approximately 5 kV from the grounded flange 10. This is essentially half the voltage drop between the grounded flange 10 and the ion source assembly. The spacer 20 is metallic and the potential can be applied directly to it.

By applying a voltage to the spacer 20 that is intermediate the voltage applied to the ion source and that applied to the grounded flange 10, the construction of the ion source assembly 30 may be made more compact and a reduction in the free volume of the ion source assembly 30 may be achieved.

Existing ion source assemblies for static mass spectrometers have been designed for 3.5 kV, but later this has been increased to around 4.2 to 4.5 kV. The limitation in the ionization voltage has depended upon the specific construction of the ion source assembly, particularly its ability to withstand arcing. At around 5 kV, the field effects leading to sparks on edges or roughness of the electrode surfaces increase, normally making it necessary to polish the surfaces and apply other optimization to prevent arcing (such as break and/or round edges). These can have limited effect at best. The spacer mitigates many of these problems. Nonetheless, avoidance of edges and roughness remains more desirable with increasing potential differences, as the peaks in the electrical field rise sharply and these "high field" points are those where discharge might start.

A 'rule of thumb' suggests that the distance between an electrode and the grounded flange 10 should be approximately 1 mm for each 1 kV of the electrode's potential.

However, the distance between the flange 10 and the spacer 20 is slightly less than 1 mm/kV, as it is found that such a ratio is possible when the electrode potential is typically no more than 5 kV. However the distance between the flange 10 and the ion source (specifically, the ionization volume 80) is set using a ratio of slightly more than 1 mm/kV, as the potential of the ion source is typically greater than 5 kV. In the design shown, the gap between the flange 10 and the spacer 20 is approximately 4 mm and the distance between the source housing 35 and the ion source is approximately 11 to 12 mm.

Although the ion optical elements 90 is shown as a single aperture, this arrangement (including the intermediate lens 95) in fact comprises four components: an extraction lens; extraction focus plates; the intermediate focus element (lens) 95; and a grounded slot. These can each be understood as diaphragms, slits or lenses. This complete lens stack is approximately 11 mm across the plane shown in FIG. 4. The potential applied to the spacer 20 is the same as that applied to the intermediate lens 95. This is a potential that is tuned for maximum performance. Then, the absolute voltage on the spacer 20 may vary with that applied to the intermediate lens 95 (possibly by up to several hundred volts).

Figure 5:
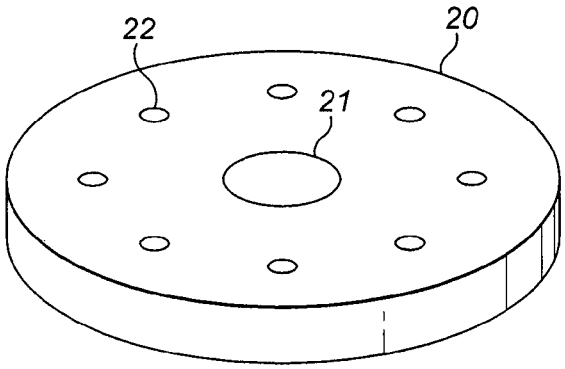
FIG. 5 shows an exemplary spacer for the ion source assembly of FIGS. 3 and 4.

Referring now to FIG. 5, there is shown an exemplary spacer for the ion source assembly of FIGS. 3 and 4. The spacer 20 is generally toroidal (or multiple toroidal) in topology, but is essentially cylindrical, with a central hole 21 and a plurality of outer holes 22. The central hole 21 can allow for the passage of sample gas into the ionization chamber 80 or may give room for further mechanical infrastructure such as mountings, alignment dowels, or such like. The outer holes 22 are intended for the feedthroughs 40 and support structure 50. The sample typically passes through the spacer from the side, which is not shown in the cross-sectional and three-dimensional projections shown.

Figure 6:
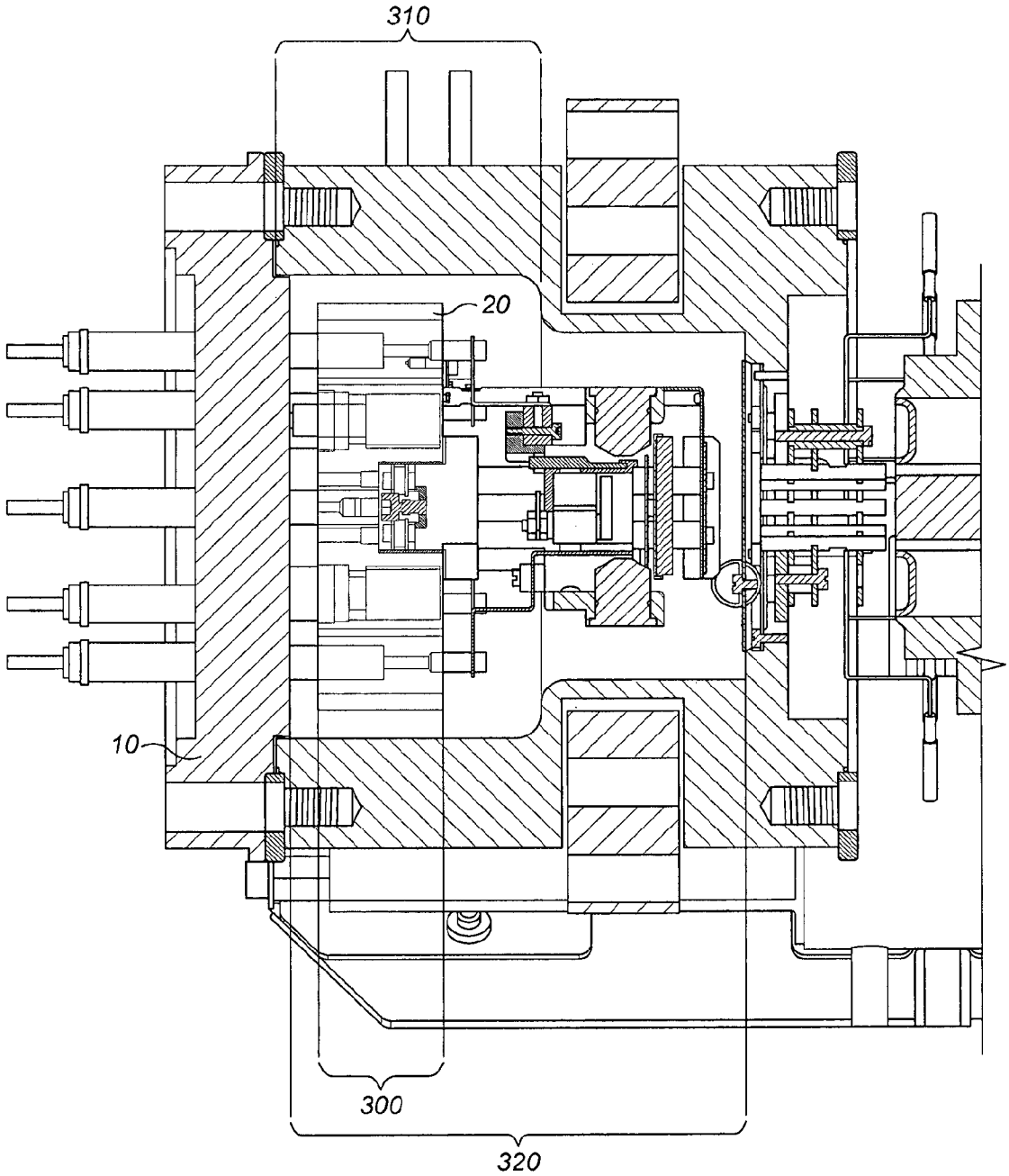
FIG. 6 shows the same detailed cross-sectional view as FIG. 3, but with additional marking to identify volumes of interest.

Referring next to FIG. 6, there is shown the same cross-section view as FIG. 3, but with additional marking to identify volumes of interest. Also marked are the flange 10 and the spacer 20. A first volume is the volume occupied by the spacer 20. In a preferred embodiment, this is around 58,000=$^3$. The immediately surrounding volume 300 has a length of about 22 mm (the thickness of the spacer 20) and a diameter of about 85 mm (the total diameter of the ion source assembly housing around the spacer) providing a volume of approximately 125,000 mm$^3$. The volume surrounding the spacer 310 also has a diameter of about 85 mm and a length of around 44 mm, giving a volume of approximately 250,000 mm$^3$. Finally, the total ion source housing volume 320 is approximately 375,000 mm$^3$.

There are consequently a number of different ratios that may be considered. A first ratio is between the volume of the spacer 20 and that of the total ion source housing volume 320, which for the values above is approximately 58000/375000=1/6.5=15.4% (values between 10% and 20% may be typical). A second ratio is between the volume of the spacer 20 and the surrounding volume 310, which for the values above is approximately 58000/250000=1/4.3=23.3% (values between 15% and 35% may be normal). A third ratio is between the volume of the spacer 20 and the immediately surrounding volume 300, which is approximately 58000/125000=1/2.15=46.5% (values between 25% and 75% may also be considered). The total interior volume of the whole mass spectrometer (including ion source assembly 30, flight tube 110 and detector housing 140) is around 3 L, giving a ratio between the volume of the spacer 20 and the total interior volume being around 2%.

Some of these ratios may at first seem insignificant in comparison with existing sources, but their achievement has previously been considered impossible using conventional techniques. Moreover, the consequent improvement in sensitivity is significant.

Although a specific embodiment has been described above, the skilled person will recognise various modifications are possible. For example, different kinds of detectors 150 may be used. Moreover, the arrangement of the components within the ion source assembly 30 may differ, whilst still providing a spacer between the grounded mounting element (specifically a part of the housing) and the ion source held at a relatively high potential. Also, arrangements with two or more such spacer elements at intermediate voltages could be advantageous, for instance in instruments and sources using even higher voltages.

Although the flange 10 is normally grounded (for safety reasons), other designs are possible.

The invention claimed is:

1. An ion source assembly for a static mass spectrometer, comprising:

a mounting element held at ground potential for locating the assembly within the static mass spectrometer;

an ion source for generating ions to be analyzed in the static mass spectrometer, the ion source being spaced from the mounting element and arranged to be held in use at a first relatively high potential $V_1$ with respect to the mounting element; and a spacer mounted between the mounting element and the ion source, the spacer arranged to be held in use at a second potential $V_2$ with respect to the mounting element, which is less than the first potential $V_1$ such that V2 lies between ground and V1.

2. The assembly of claim 1, wherein the ion source is supported upon the spacer, the assembly further comprising one or more electrical feed throughs which pass through but are insulated from the spacer and the mounting element.

3. The assembly of claim 1, wherein the spacer is formed of a conductive material.

4. The assembly of claim 3, wherein the spacer is metallic.

5. The assembly of claim 1, further comprising a spacer support structure that positions the spacer relative to the mounting element.

6. The assembly of claim 5, wherein the mounting element comprises a flange and the spacer support structure is affixed to the flange.

7. The assembly of claim 5, wherein the mounting element comprises a housing and the spacer comprises a flange affixed to the housing.

8. The assembly of claim 1, further comprising:

an ion source support structure that positions the ion source relative to the spacer.

9. The assembly of claim 8, wherein the ion source support structure is affixed to the spacer.

10. The assembly of claim 1, wherein the relatively high first potential $V_1$ is between 8 kV and 12 kV with respect to the mounting element.

11. The assembly of claim 1, wherein the second potential $V_2$ is between 4 kV and 6 kV with respect to the mounting element.

12. The assembly of claim 1, wherein the second potential $V_2$ is approximately half the first potential $V_1$.

13. The assembly of claim 1, further comprising an ion optical element arranged to be held in use at a potential suitable for acceleration of ions generated by the ion source and wherein the second potential $V_2$ is the same as the potential at which the ion optical element is arranged to be held.

14. The assembly of claim 1, wherein the mounting element comprises a flange and the distance between the flange and spacer is less than half the distance between the flange and the ion source.

15. The assembly of claim 1, wherein the distance between the mounting element and the spacer is no more than 1 mm per kilovolt of the second potential $V_2$.

16. The assembly of claim 1, wherein the distance between the spacer and the ion source is no less than 1mm per kilovolt of the difference between the first potential $V_1$ and the second potential $V_2$.

17. A static mass spectrometer comprising: an evacuable housing;

an ion source assembly in accordance with claim 1, mounted upon the housing so that the ion source is located therewithin; and a mass analyzer for detecting and analyzing ions generated by the ion source.

18. The static mass spectrometer of claim 17, wherein the mass analyzer is mounted upon the housing so that the mass analyzer is located therewithin.

19. An ion source assembly for a static mass spectrometer, comprising:

a mounting element for locating the assembly within the static mass spectrometer;

an ion source for generating ions to be analyzed in the static mass spectrometer, the ion source being spaced from the mounting element and arranged to be held in use at a first relatively high potential V1 with respect to the mounting element;

a spacer mounted between the mounting element and the ion source, the spacer arranged to be held in use at a second potential V2 with respect to the mounting element, which is less than the first potential V1; and one or more electrical feed throughs which pass through but are insulated from the spacer and the mounting element.

20. An ion source assembly for a static mass spectrometer, comprising:

a mounting element for locating the assembly within the static mass spectrometer;

an ion source for generating ions to be analyzed in the static mass spectrometer, the ion source being spaced from the mounting element and arranged to be held in use at a first relatively high potential V1 with respect to the mounting element; and a spacer mounted between the mounting element and the ion source, the spacer arranged to be held in use at a second potential V2 with respect to the mounting element, which is less than the first potential V1, wherein the ion source is supported upon the spacer.

* * * * *